US007691002B2

(12) United States Patent
Casey et al.

(10) Patent No.: US 7,691,002 B2
(45) Date of Patent: Apr. 6, 2010

(54) AMUSEMENT RIDE VEHICLE WITH SENSORY STIMULATION EFFECTS

(75) Inventors: Joseph F. Casey, Orlando, FL (US); Michael R. Kiddoo, Orlando, FL (US); Steven C. Blum, Orlando, FL (US); William F. Whitcomb, Saugus, CA (US); Scott R. Trowbridge, Windermere, FL (US)

(73) Assignee: Universal City Studios LLLP, Universal City, CA (US)

( * ) Notice: Subject to any disclaimer, the term of this patent is extended or adjusted under 35 U.S.C. 154(b) by 173 days.

(21) Appl. No.: 11/948,296

(22) Filed: Nov. 30, 2007

(65) Prior Publication Data

US 2008/0070709 A1 Mar. 20, 2008

Related U.S. Application Data

(63) Continuation of application No. 11/182,478, filed on Jul. 15, 2005, now abandoned.

(60) Provisional application No. 60/637,082, filed on Dec. 17, 2004.

(51) Int. Cl.
*A63J 5/00* (2006.01)
*A63J 23/00* (2006.01)

(52) U.S. Cl. ..... 472/59; 472/55

(58) Field of Classification Search ..... 472/52, 472/54–56, 61, 65, 137, 59, 60, 43; 446/214
See application file for complete search history.

(56) References Cited

U.S. PATENT DOCUMENTS

| | | | | | |
|---|---|---|---|---|---|
| 643,493 | A | * | 2/1900 | Fuller | 472/65 |
| 1,423,089 | A | * | 7/1922 | Cushman | 472/61 |
| 2,851,270 | A | * | 9/1958 | Ball | 472/53 |
| 3,628,829 | A | * | 12/1971 | Heilig | 297/217.4 |
| 4,066,256 | A | * | 1/1978 | Trumbull | 472/60 |
| 5,669,821 | A | * | 9/1997 | Prather et al. | 472/59 |
| 5,716,281 | A | * | 2/1998 | Dote | 472/60 |
| 5,807,177 | A | * | 9/1998 | Takemoto et al. | 463/47 |
| 6,079,982 | A | | 6/2000 | Meader | |
| 6,095,926 | A | | 8/2000 | Hettema | |
| 6,220,171 | B1 | | 4/2001 | Hettema | |
| 6,224,491 | B1 | | 5/2001 | Hiromi | |

* cited by examiner

*Primary Examiner*—Kien T Nguyen
(74) *Attorney, Agent, or Firm*—GE Global Patent Operation; Roger C. Phillips

(57) ABSTRACT

A ride vehicle includes a tactile or physical contact system. The ride vehicle moves along a path or track. The path or track can be outdoors or partially or entirely indoors, i.e., in a dark ride. The system provides a touch effect by causing a physical or solid touch element to make physical contact with a part of a rider's body. Alternatively, the system can operate by projecting or spraying a gas, such as air, a vapor, such as water vapor or steam, or even a liquid, such as water, toward or onto part of a rider's body or the rider's clothing. The system is advantageously substantially self-contained aboard the vehicle, but may receive power or working fluid from off-board sources, either at discrete locations, or continuously along the ride path.

4 Claims, 3 Drawing Sheets

AMUSEMENT RIDE VEHICLE WITH SENSORY STIMULATION EFFECTS

CROSS REFERENCE TO RELATED APPLICATIONS

This application is a continuation of U.S. patent application Ser. No. 11/182,478, filed Jul. 15, 2005, now abandoned the entire contents of which is incorporated herein by reference to the extent necessary to make and use the present invention, which, in turn, claims benefit of U.S. Provisional Patent Application Ser. No. 60/637,082, filed Dec. 17, 2004, the entire contents of which is incorporated herein by reference to the extent necessary to make and use the present invention.

BACKGROUND OF THE INVENTION

The field of the invention is amusement rides. Various forms of amusement rides have been used for many years in amusement or theme parks. These include traditional rides such as roller coasters, round rides and water rides. Over the last several years, so-called dark rides having ever more sophisticated technology and effects have been developed. Dark rides generally have ride vehicles carrying one to several passengers or riders through one or more scenes or rooms. The scenes typically have themed ride effects or elements, props, animated figures, projected images, and other 'show effects' that enhance the ride experience. The ride vehicles may travel along a fixed track, guide way, trough, or other mechanically or electrically limited path. Alternatively, the ride vehicles may be guided by on board or external computers or control systems. These alternative designs may use, for example, global or other positioning systems, laser guidance, wire guided, or optical systems. Since not mechanically limited in these cases, the vehicle path can be easily changed or varied.

The themed ride effects or elements are traditionally placed in areas adjacent to the vehicle path. Many dark rides strive to create a 'temporary suspension of reality', with the riders temporarily convinced that they are in the fictional environment made up of the ride elements (e.g., scenery, props, special effects, animated or robotic figures, projected or lighting effects, etc.) Of course, the ability to actually achieve this result is necessarily limited by the rider's prior knowledge that they are, in fact, participating in an amusement ride and not in a 'real' event.

Accordingly, there is a need for new ride elements that play psychologically to the rider's perception of reality, and that provide more dramatic, realistic, personal, and thrilling ride experiences. Until now, most efforts by ride designers have been directed to increasing the impact and proximity (or perceived proximity) of off-board ride elements that the riders see, hear, or smell. More recently, some rides have included on-board visual and sound effects. However, tactile effects have been generally limited to the motion of the amusement ride vehicle itself, and to low frequency sound effects. Accordingly, a need exists for on-board tactile stimulation of riders to better provide for a suspension of reality effect and to enhance the overall ride experience.

SUMMARY OF THE INVENTION

A ride vehicle includes a tactile or physical contact system. The system provides a touch effect by causing a physical or solid touch element to make physical contact with a part of a rider's body. Alternatively, the system can operate by projecting or spraying a gas, such as air, a vapor, such as water vapor or steam, or even a liquid, such as water, toward or onto part of a rider's body (or the rider's clothing). As a further alternative, the ride vehicle system may include sensory stimulation such as sounds, smells and visual effects.

The physical contact of the contacting member, or the impingement of the jet, spray or blast of air or water, helps to increase the riders' sensory perception of a temporary suspension of reality. Consequently, the entertainment and thrill value of the ride is improved. The tactile stimulation system of the invention may be used in various types of rides, including roller coasters, water rides, dark rides, and others.

Other and further objects and advantages will become apparent from the following description. The drawings are intended to show examples of the many forms of the invention. The drawings are not intended as showing the limits of all of the ways the invention can be made and used. Changes to and substitutions of the various components of the invention can of course be made. The invention resides as well in sub-combinations and sub-systems of the elements described, and in methods of using them.

DETAILED DESCRIPTION OF THE DRAWINGS

An amusement ride vehicle includes a rider contacting or stimulation system that physically contacts the rider and provides a sensory experience. Consequently, the rider's sense of touch is brought into the ride/show experience. The rider contacting system is actuated to provide tactile effects at pre-programmed locations or times during the amusement ride show. The result is a dramatic and more thrilling ride experience, especially when used in combination with other path or track ride effects, such as linear or centrifugal acceleration, and/or with motion base effects, such as pitch/roll/yaw or surge/heave/sway, and/or with other on-board, off-board, or on and off-board visual or sound effects. The contact or touching of the rider can be made with a solid element, or with a liquid or a gas or vapor, or with a combination of one or more of them. In vehicles having multiple riders, the system may contact all riders simultaneously. Alternatively, the system may contact the riders separately, and at different times.

Figure 1:
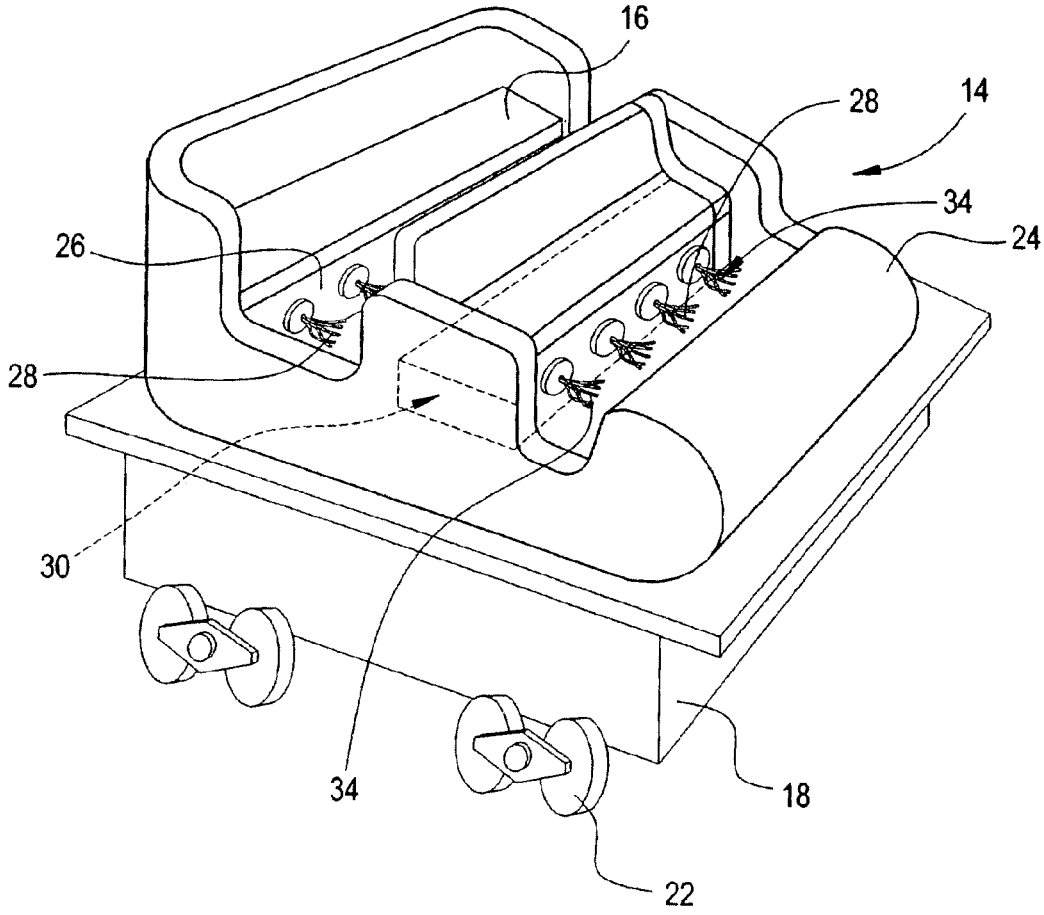
FIG. 1 is a perspective view of a ride vehicle having the tactile stimulation or touch effect system of the invention.
Figure 2:
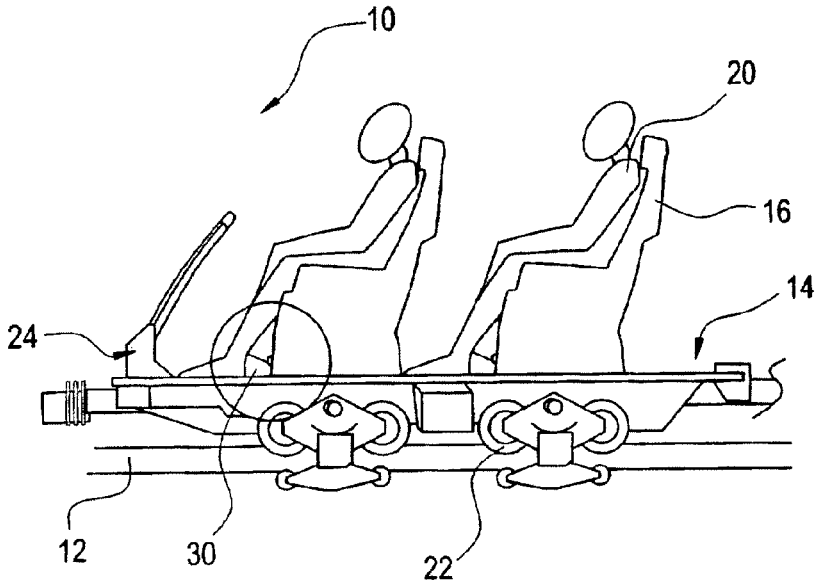
FIG. 2 is a schematic side view, in part section, of the ride vehicle of FIG. 1 shown on a track of a ride attraction, in an amusement or theme park setting.

Turning now in detail to the drawings, as shown in FIGS. 1 and 2, a ride vehicle 14 has rider positions 16 in or on a vehicle body 24. Riders 20 sit or stand in the rider positions 16. The rider positions 16 may be seats or stand-up positions or locations, although seats are generally used. The number of rider positions may vary depending on the vehicle and ride design. In general, the vehicle will have one or more positions 16. Several vehicles may be attached together to form a train of vehicles.

The vehicles move on wheel assemblies 22 along a path or track 12. The vehicle body 24 may be supported on a movement base, which may be an articulated linkage, or a multiple axis motion base, for example, as described in U.S. Pat. No. 6,095,926, incorporated herein by reference.

Figure 3:
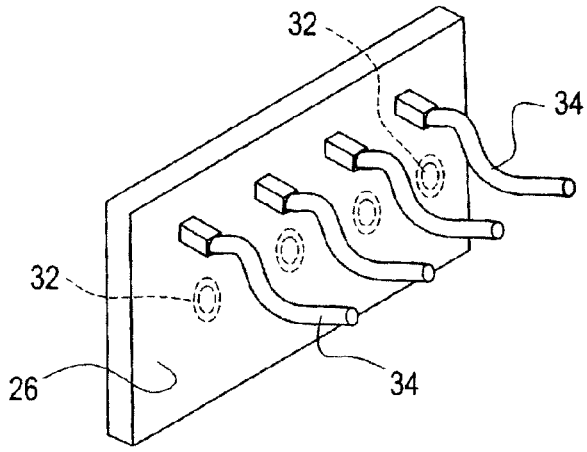
FIG. 3 is an enlarged perspective view of contacting elements as used in a second embodiment of the invention.
Figure 4:
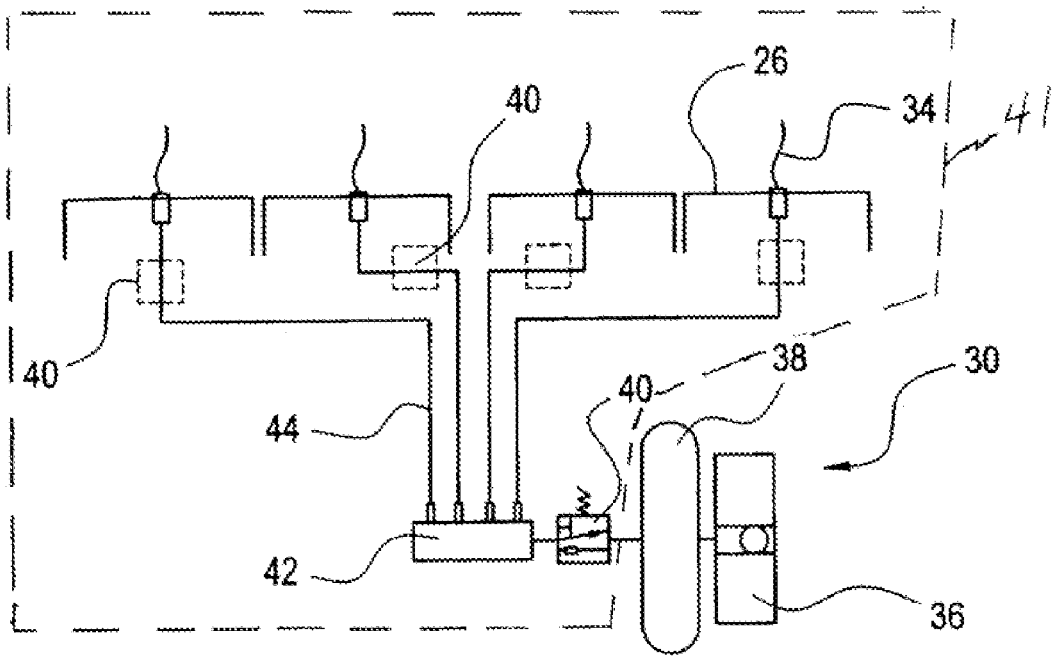
FIG. 4 is a schematic drawing of the tactile effect system shown in FIG. 1 or 3.

Turning now to FIGS. 1, 3 and 4, a rider contact system 30 on the ride vehicle 14 has one or more contacting elements 34 that make momentary physical or touch contact with a rider. This can be achieved in many different ways. In one design, the rider contact system 30 includes an air compressor 36 that supplies compressed air to a storage tank or bottle 38. One or more control valves 40-control flow of compressed air from the tank, through a supply line or hose, to a manifold 42. A single valve 40, as shown in solid lines in FIG. 4, or multiple separate valves 40, as shown in dotted lines in FIG. 4, may be used. Multiple separate air lines or hoses from the manifold connect to contacting elements 34. Alternatively, a compressed air or gas source of any type can be connected directly to the contacting elements through one or more valves, without using a gas storage tank, or a manifold.

The contacting elements 34 are attached to the seat wall 26, or at another location where they do not interfere with the riders. Generally, the contacting elements are also located or installed so that they are not so easily visible by the riders, such as behind the riders' legs, on or adjacent to the seat wall 26. The contacting elements can of course also be positioned to contact other parts of the rider's body. The contacting elements may also be positioned so that they are in plain sight of the rider, with or without using techniques (such as lighting, patterning, shaping, camouflaging, etc.) to make them less noticeable.

In a typical design, electrical power is transmitted on board to an amusement ride vehicle 14 by connection to an electrically powered buss rail or inductive pickup extending along the track or path 12. The electrical power is regulated and converted as needed in an on board power supply, which powers the on-board pneumatic compressor 36. The compressor 36 pressurizes the tank 38. The compressor 36 may alternately be powered via on board electrical power storage, such as batteries or capacitors, when facility power from the buss connection(s) is not available.

The storage tank 38 is plumbed to the distribution manifold 42 and a plurality of controlled 'effect' valves. The effect valves 40 are designed to open and close to control flow and flow rate change, as specified by the creative intent of the effect. The valves are controlled via signal provided by one or more on or off-board computer or control systems. The effect valves 40 are triggered to an open, closed, or modulated state following a specified profile in conjunction or coordination with amusement ride vehicle position along the track or guide way, and/or events occurring within the overall ride/show. Air flow released via action of the valves flows to the contacting element, or to a contacting element actuator which drives the contacting element.

The contacting elements 34 in this particular design are flexible or extendible elements. In operation, when energized by the inflow of compressed air released by the effect valves, the contacting elements 34 are designed to contact, rub, strike, or vibrate against the rider at a specific location on the rider's body, or the clothing on the body. In this air driven design, the contacting members may be hollow flexible tubes, bellows-like designs, segmented or articulated designs, with or without spring elements. The contacting elements may also have projections and/or weighted ends, so that riders can sense touch a contacting element with reduced or slower contacting element movement.

FIG. 1 shows another compressed air-driven design. In FIG. 1, the contacting elements are in the form of flexible strands 28 mounted adjacent to air nozzles 32.

In an embodiment of the invention, the system is a sensory stimulation system for providing visual, olfactory, aural and/or tactile stimulation. Fluid or fluid-like contact media, such as water, steam, smoke, fog, confetti, fake snow, hot or cold air, etc. can also be used as a contacting and/or visual, or olfactory media. These same media may provide audio effects as well when they are activated. Other audio media can also be provided on-board the ride vehicle. These types of media can be stored and delivered on-board. Alternatively, they may be stored or sourced off-board and supplied to an on-board duct, hood, pipe, etc. for delivery around, towards, or onto a rider, before, during, or after a ride sequence. FIG. 4 includes broken line to represent a vehicle 41 configured when the media is sourced off-board from the compressor 36 and tank 38 which are, in this optional embodiment, located off-board of the vehicle. The visual, olfactory and/or aural effects of the on-board sensory stimulation system can be provided atone or combined with each other and/or the tactite stimulation contacting elements 34. The visual, olfactory and/or aural effects of the on-board sensory stimulation system can be delivered from any suitable location on the ride vehicle 14, including the same locations as the contacting elements 34, or in any of the other locations identified as suitable for the contacting elements 34 when both are present on the ride vehicle 14.

While air driven contacting elements have some advantages, other forms of contacting elements 34 may also or alternatively be used. For example, other forms of contacting elements may be actuated by electrical (motor, solenoid, etc.), pneumatic (high velocity air stream, rotary actuator, etc.), or other means. Power for driving the contacting elements 34 may be stored or generated on board the ride vehicle, (e.g., by batteries, springs, accumulators, engines, etc.), or transmitted onto the vehicle from an external source (e.g., by connection to a conventional buss bar, inductive coupling, etc.) As used here, on-board means the element or system component is physically located on a vehicle, including an element or system component on one vehicle that provides a result on another vehicle, e.g., on a train or group of vehicles. However, an on-board element may receive power, data, or an effect media (such as compressed air, electrical power, water, fog, steam, smoke, confetti, glitter, etc.) from one or more off-board sources. Such off board supplies typically require associated vehicle positioning equipment and vehicle to off board system docking equipment and procedures.

In FIG. 3, the contacting elements 34 are designed so that they coil up against the seat wall 26 when not deployed. Air flow rates are adjusted such that the tubes uncoil and vibrate as a result of flow, touching the rider's lower leg area. This can create a desired tactile sensation in coordination with the ride/show. For example, especially when used with on-board, off-board, or combined on and off-board visual or other effects, the vibrating contacting elements may create the sensation that insects are crawling on the rider's legs.

Thus, a novel ride system and ride vehicle has been shown and described. Various changes and substitutions can of course be made to the description above, all within the spirit and scope of the invention. The invention, therefore, should not be limited, except to the following claims, and their equivalents.

The invention claimed is:

1. An amusement ride comprising;

a vehicle path;

at least one vehicle moveable along a vehicle path;

at least one rider position on or in the vehicle; and a rider sensory stimulation system on the vehicle, including means for delivering a sensory stimulation effect to a rider a the rider position;

wherein the sensory stimulation system comprises a source of compressed air connectable to a contacting element moveable to contact a rider at the rider position, and the contacting element comprises one or more flexible members positioned on the vehicle to contact the rider.

2. The amusement ride of claim 1 further comprising a power source on the vehicle for actuating the means for delivering.

3. The amusement ride of claim 1 wherein the vehicle comprises a chassis, a movement base on the chassis, and a cabin on the movement base, with the rider positioned in the cabin.

4. The amusement ride of claim 1 further comprising a control system linked to the rider sensory stimulation system, for actuating the means for delivery in a timed sequence coordinated with the location of the vehicle along the path, or with a predetermined time during the ride.

* * * * *